United States Patent [19]

Cunningham

[11] Patent Number: 4,733,055

[45] Date of Patent: Mar. 22, 1988

[54] HEAT TRANSFER HEATING ELEMENT AND METHOD

[75] Inventor: Donald M. Cunningham, Pittsburgh, Pa.

[73] Assignee: Emerson Electric Co., St. Louis, Mo.

[21] Appl. No.: 900,175

[22] Filed: Aug. 25, 1986

[51] Int. Cl.[4] ..... H05B 3/06; H01C 1/012; B05D 5/12

[52] U.S. Cl. ..... 219/540; 219/237; 219/238; 219/241; 219/541; 219/550; 219/551; 219/552; 219/553; 338/305; 338/310; 427/126.3; 427/404

[58] Field of Search ..... 219/237, 238, 241, 540, 219/1, 550–553, 227; 338/303–308; 427/49, 58, 94, 126.3, 404; 428/414–434

[56] References Cited

U.S. PATENT DOCUMENTS 3,521,213 7/1970 Hardy ..... 338/296

4,544,829 10/1985 Adachi et al. ..... 219/237

4,621,182 11/1986 Driggers ..... 219/85 BM

*Primary Examiner*—E. A. Goldberg

*Assistant Examiner*—Gerald E. Preston

*Attorney, Agent, or Firm*—Polster, Polster and Lucchesi

[57] ABSTRACT

An electric heating element with a resistance element, a metal sheath in heat transfer relation to the resistance element on one side of the sheath and a thin, dry coating of refractory material major proportion by weight of which is boron nitride on another side of the sheath to be placed in heat transfer relation to an object to be heated. A method of enhancing the heat-transfer qualities of a metal sheathed electric heating element includes coating the metal sheath, on a surface to be placed in heat-transfer relation to an object to be heated, with a liquid slurry of refractory material a major proportion of which is boron nitride, drying and outgassing the coating and mounting the sheathed element on an object to be heated with the coating in contact with the object.

7 Claims, No Drawings

HEAT TRANSFER HEATING ELEMENT AND METHOD

BACKGROUND OF THE INVENTION

This invention has particular application to cartridge heaters, but its applicability is not confined to them.

In installing cartridge heater units, it is desirable that the cylindrical sheath of the cartridge be in intimate contact with the object to be heated. At the same time, it is not practical to have a press or interference fit between the wall of the hole in the object into which the cartridge is inserted and the cartridge, because the cartridge heater element will eventually fail, and it is necessary to remove the cartridge. Accordingly, it has been customary to drill and then ream the wall defining the hole into which the cartridge heater is to be inserted, to get as close a fit as possible, but yet to be able to remove the cartridge when it is to be replaced.

Refractory coatings containing a major proportion of boron nitride have been known as high temperature lubricants, anti-sticking agents and mold release agents, resistant to corrosion and to molton metals.

It has been found, that contrary to what might be thought to be a disadvantage of interposing a coating of refractory between a heating element and the object to be heated, the interposition of a refractory coating predominantly of boron nitride, under certain circumstances, provides a more efficient heat transfer and has certain other advantages as well. The increased efficiency alone provides a marked increase in the life expectancy of the heating elements.

One of the objects of the this invention is to provide metal sheathed elements more efficient than those know heretofore.

Another object is to provide a method of producing such elements that is simple and that facilitates mounting of the elements.

Other objects will become apparent to those skilled in the art in the light of the following disclosure.

SUMMARY OF THE INVENTION

In accordance with this invention, generally stated, in an electric heating element of the type including an electric resistance element and a metal sheath in heat transfer relation to the resistance element on one side of the metal sheath, a thin, dry coating of refractory material, a major proportion by weight of which is boron nitride, is provided on another side of the sheath to be placed in heat transfer relation to an object to be heated. A method of enhancing the heat-transfer qualities of a metal sheathed electric heating element includes coating the metal sheath, on a surface to be placed in heat-transfer relation to an object to be heated, with a liquid slurry of refractory material a major proportion of which is boron nitride, drying and outgassing the coating and mounting the sheathed element on an object to be heated with the coating in contact with the object. In the preferred embodiment described, the heating element is a cylindrical cartridge heater. A hole of a substantially uniform diameter is formed in the object to be heated. The hole is larger than the diameter of the uncoated heater but smaller than the coated heater. The mouth of the hole is defined by a sharp arris. The coated heater is inserted into the hole while simultaneously scraping excess coating from the heater at the mouth of the hole. This results in an essentially zero clearance fit. It has been found that by the use of this method, the hole in which the cartridge heater is to be seated need not be reamed to a precise dimension, a hole as much as 0.010" oversize in diameter being easily accommodated by the coating and providing more efficient heat transfer even with that thickness of coating (0.005"), than an uncoated heater.

DESCRIPTION OF THE PREFERRED EMBODIMENT

As an example, a mixture of approximately 86% boron nitride and 14% aluminum oxide by weight is suspended in water, the water making up approximately 75% of the slurry by weight. A slurry or paint of about this composition is commercially available from ZYP Coatings, Inc., of Oak Ridge, Tenn. Three-eighths inch cartridge heaters, free of grease, are dipped in the slurry and air dried. The process is repeated sufficiently to build up a coating of 0.005 to 0.010 inches after drying. The coated heaters are then heated to about 200° F. to drive off any moisture and then baked at approximately 900° F. to outgas the coating. The coating has a soap-like texture, and provides an attractive white appearance.

A hole of a diameter closely to receive the cartridge, preferably less than 0.005 inches larger than the uncoated cartridge heater, is formed in the platen or die in which the heater is to be installed. Preferably the mouth of the hole is defined by a sharp arris between the external surface of the die or platen and the wall defining the hole, and the hole is of substantially uniform diameter. The coated cartridge is now inserted in the hole, the arris at the mouth serving to scrape away any excess coating as it is being inserted.

It is found that the sheath temperature of a coated cartridge is substantially lower than that of an uncoated cartridge. The spread becomes greater at higher sheath temperatures. It is calculated that at 170 watts per square inch, giving the sheath a temperature in the range of 1002° F. to 1037° F. for coated cartridges as compared with the neighborhood of 1080° F. for uncoated ones, the difference will extend the life approximately 87%. At higher sheath watt densities, the improvement will increase.

The coating not only improves the appearance and efficiency of the heater, but also makes its installation and removal easier. By eliminating the need for precision reaming, the coating also reduces the labor and effort of forming the holes into which the heater is to be mounted. If the hole is slightly oversized, or out of round, the coating will still provide a nearly perfect fit. The coating can be put on by the manufacturer of the cartridge heaters, or it can be done by the user.

The coating can be applied by spraying or brushing, as well as by dipping, although dipping is a simple and effective method. The composition of the coating can be varied, as by using boron nitride alone, which gives excellent results but is expensive, or by adding different electrically insulative, thermally conductive materials, such, for example, as magnesium oxide, zirconium oxide or silicon carbide, as long as the major proportion of the refractory dry coating is boron nitride. Such a coating can also be utilized with other metal sheathed heating elements, such as stud bolt heaters, strip heaters, and many metal sheath heater clamp-on devices. The nature of the coating is such as to tend to fill the space between the heater sheath and the object to which it is mounted.

Numerous other variations in the heater and method, within the scope of the appended claims, will become apparent to those skilled in the art in the light of the foregoing disclosure.

I claim:

1. An electric heating element comprising a resistance element, a metal sheath in heat transfer relation to said resistance element on one side of said metal sheath and a soap-like coating of a mixture of boron nitride and refractory material taken from the group consisting of aluminum oxide, magnesium oxide, zirconium oxide and silicon carbide on another side of said sheath to be placed in heat transfer relation to an object to be heated.

2. An electric heating element comprising a resistance element, a metal sheath in heat transfer relation to said resistance element on one side of said metal sheath and a soap-like coating of refractory material a major proportion by weight of which is boron nitride, on another side of said sheath to be placed in heat transfer relation to an object to be heated.

3. An electric heating element comprising a resistance element, a metal sheath in heat transfer relation to said resistance element on one side of said metal sheath and a soap-like coating and consisting essentially of boron nitride, on another side of said sheath to be placed in heat transfer relation to an object to be heated.

4. The element of claim 3 wherein the element is a cylindrical cartridge heater, the object to be heated has a hole in it defined by a wall, and the coating fills the space between the outside cylindrical surface of the sheath and the wall defining said hole.

5. The element of claim 2 wherein the element is a cylindrical cartridge heater, the object to be heated has a hole in it defined by a wall, and the coating fills the space between the outside cylindrical surface of the sheath and the wall defining said hole.

6. The method of enhancing the heat-transfer qualities of a metal sheathed electric heating element comprising coating said metal sheath, on a surface to be placed in heat-transfer relation to an object to be heated, with a liquid slurry of refractory material a major proportion of which is boron nitride, drying and outgassing said coating and mounting said sheathed element on an object to be heated with said coating in contact with said object.

7. The method of claim 6 wherein said heating element is a cylindrical cartridge heater, including the steps of forming a hole in the object to be heated of a substantially uniform diameter, larger than the diameter of the uncoated heater but smaller than the coated heater, the mouth of said hole being defined by a sharp arris, inserting said coated heater into said hole while simultaneously scraping excess coating from said heater at the mouth of said hole.

* * * * *